US005266392A

United States Patent [19]

Land et al.

[11] Patent Number: 5,266,392

[45] Date of Patent: Nov. 30, 1993

[54] PLASTOMER COMPATIBILIZED POLYETHYLENE/POLYPROPYLENE BLENDS

[75] Inventors: Louis P. Land, Alpharetta, Ga.; Angelo A. Montagna, Houston, Tex.; Kenneth W. Bartz, Baytown, Tex.; Aspy K. Mehta, Humble, Tex.

[73] Assignee: Exxon Chemical Patents Inc., Linden, N.J.

[21] Appl. No.: 945,545

[22] Filed: Nov. 16, 1992

Related U.S. Application Data

[63] Continuation-in-part of Ser. No. 760,623, Sep. 16, 1991, abandoned.

[51] Int. Cl.[5] ..... C08L 23/10; C08L 23/08; C08L 23/16; C08L 23/18

[52] U.S. Cl. ..... 428/224; 525/240; 525/931; 428/516; 428/284

[58] Field of Search ..... 525/240; 428/224

[56] References Cited

U.S. PATENT DOCUMENTS

| | | | |
|---|---|---|---|
| 4,634,735 | 1/1987 | Thiersault et al. | 525/240 |
| 4,748,206 | 5/1988 | Nogiwa et al. | 525/240 |
| 4,769,283 | 9/1988 | Sipinen et al. | 525/240 |
| 4,833,195 | 5/1989 | Adier et al. | 525/240 |
| 4,839,228 | 6/1989 | Jezic et al. | 525/240 |
| 5,011,891 | 4/1991 | Spenadel et al. | 525/211 |

FOREIGN PATENT DOCUMENTS

| | | |
|---|---|---|
| 170255 | 2/1986 | European Pat. Off. . |
| 192897 | 9/1986 | European Pat. Off. . |
| 3544523 | 6/1986 | Fed. Rep. of Germany . |
| 58-101135 | 6/1983 | Japan . |
| 59-43043 | 4/1984 | Japan . |

*Primary Examiner*—Carman J. Seccuro, Jr.
*Attorney, Agent, or Firm*—Catherine L. Bell; Myron B. Kurtzman

[57] ABSTRACT

Compatibilized blends of polypropylene, linear low density polyethylene and a low molecular weight plastomer are disclosed. The blend preferably contains at least about 50 percent by weight of crystalline polypropylene, from about 10 to about 50 percent by weight of LLDPE dispersed in a matrix of the polypropylene, and a compatibilizing amount of an ethylene/alpha-olefin plastomer having a weight average molecular weight between about 5,000 to about 50,000, a density of less than about 0.90 g/cm$^3$, and a melt index of at least about 50 dg/min. The blend is useful in the formation of melt spun and melt blown fibers. Also disclosed are spun bonded-melt blown-spun bonded fabrics made from the blends.

32 Claims, 1 Drawing Sheet

PLASTOMER COMPATIBILIZED POLYETHYLENE/POLYPROPYLENE BLENDS

This Invention is a continuation in part of U.S. Ser. No. 07/760,623 filed Sep. 16, 1991, now abandoned.

FIELD OF THE INVENTION

This invention pertains to blends of polyethylene and polypropylene, and particularly to such blends which are compatibilized with a low molecular weight plastomer so that they are suitable for use in applications such as, for example, fibers used in nonwoven fabrics.

BACKGROUND OF THE INVENTION

There is a great demand for polyolefin fibers which can be used in applications such as inner cover stock for disposable diapers and sanitary napkins. In such applications, the fibers are formed into nonwoven fabrics which have specific property requirements, including soft hand (comfortable touch to the skin), light-weightness and high tensile strength. The fibers can be bonded together to form a nonwoven fabric by several conventional techniques. The needle punch method, for example, interlaces fibers to bond them into a fabric. Fiber binding has also been achieved by depositing a solution of adhesive agent on webs of the fibers, but this requires additional processing and energy to remove the solvent from the adhesive agent. Another approach has been the use of binder fibers having a lower melting point than the primary bulk fibers in the fabric. The binder fibers are heated to fuse to the bulk fibers and produce the nonwoven fabric.

Various attempts have been made in the prior art to employ polyethylene in the manufacture of fibers. Fibers containing polyethylene and polypropylene have been used to manufacture nonwoven fabrics. Polypropylene fibers are known for their high strength and good processability, but suffer from a lack of softness (poor hand). Polyethylene, on the other hand, is known for its good hand, but has poor strength and processability. Blending the polyethylene and polypropylene to form fibers having a good balance of properties has been a long sought goal, i.e. a polyolefin with the hand of polyethylene, but having the strength and processability characteristics of polypropylene. However, problems have been encountered in the manufacture of polyolefin fibers containing both polyethylene and polypropylene. Low density polyethylene (LDPE) and high density polyethylene (HDPE) have been used as bicomponent fiber-forming polymers but are not popular because nonwoven fabrics produced using these polyethylenes have unsatisfactory rigid hand and do not feel soft. Linear low density polyethylene (LLDPE) and polypropylene are generally immiscible and incompatible. Biconstituent fibers containing them generally have a "bicomponent" morphology, i.e. the polyethylene and polypropylene are present in the fibers in co-continuous phases (side-by-side or sheath/core) rather than a dispersion of fibrils of one constituent in a matrix of the other. This has in turn led to various processing problems which are generally addressed by the judicious selection of polyethylene and polypropylene having a specific density and melt index or melt flow ratio.

U.S. Pat. No. 4,874,666 teaches biconstituent fibers produced by melt spinning a blend comprising more than 50 weight percent of a linear low density polyethylene (LLDPE) having a melt index (MI) of 25–100 dg/min and heat of fusion below 25 cal/g, and less than 50 weight percent of crystalline polypropylene having a melt flow rate (MFR) below 20 dg/min. It is stated that these fibers can be produced at relatively high spinning rates. However, it is taught that if the MI of the LLDPE is below 25, fibers cannot be made by high speed spinning, and if the MI of the LLDPE is higher than 100, its viscosity does not match the polypropylene so that a uniform blend cannot be obtained during melt spinning and a serious defect will take place in that the filaments being extruded will frequently break as they emerge from the spinnerette. It is similarly taught that the LLDPE must have the low heat of fusion in order to obtain a uniform blend. Similarly, it is taught that a crystalline polypropylene cannot have an MFR exceeding 20 or uniform blending with the LLDPE cannot be obtained by any of the known commonly employed spinning apparatus, and as a result, great difficulty is involved in spinning the blend at high speed. It is also taught that the LLDPE in the spun fibers is a continuous phase and the polypropylene is a dispersed phase, and that too great a difference in the melt viscosities between the LLDPE and polypropylene results in the dispersed polypropylene particle size being too large for smooth high-speed spinning.

U.S. Pat. No. 4,839,228 discloses a two-part blend of polypropylene with 20 to 45 wt. % LLDPE or alternatively LDPE or HDPE for the production of fibers.

U.S. Pat. No. 4,748,206 discloses a four-part blend of 20 to 70 weight percent crystalline polypropylene, 10 to 50 weight percent amorphous copolymer (EPR), 5 to 50 weight percent ethylene/alphalpha-olefin copolymer, typically ULDPE and 5 to 30 weight percent LLDPE or HDPE to be used for molded articles.

U.S. Pat. No. 4,634,735 discloses a three-part blend of 50 to 97 wt. % isotactic polypropylene, 2 to 49% elastomer (EPR) and 1 to 30 wt. % LLDPE with a density of up to 0.935 for production of molded articles.

JP 9043-043-A discloses a three-part blend of 100 parts by weight polypropylene, 3 to 10 parts by weight LLDPE, and 5 to 15 parts by weight of elastomer, typically EPR for production of film.

U.S. Pat. No. 4,833,195 discloses a three-part blend of an oligomer or degraded polyolefin, typically polypropylene, blended with an olefinic elastomer, typically EPR, and thermoplastic olefin with functional group which is typically LLDPE for the production of films and fabrics.

The latter four references all disclose blends containing elastomer rather than plastomer. As will be discussed below plastomers have significant differences from elastomers. Briefly, the plastomers of this invention have higher crystallinity than elastomers which translates to unexpectedly greater strength and abrasion resistance properties, among others.

SUMMARY OF THE INVENTION

Figure 1:
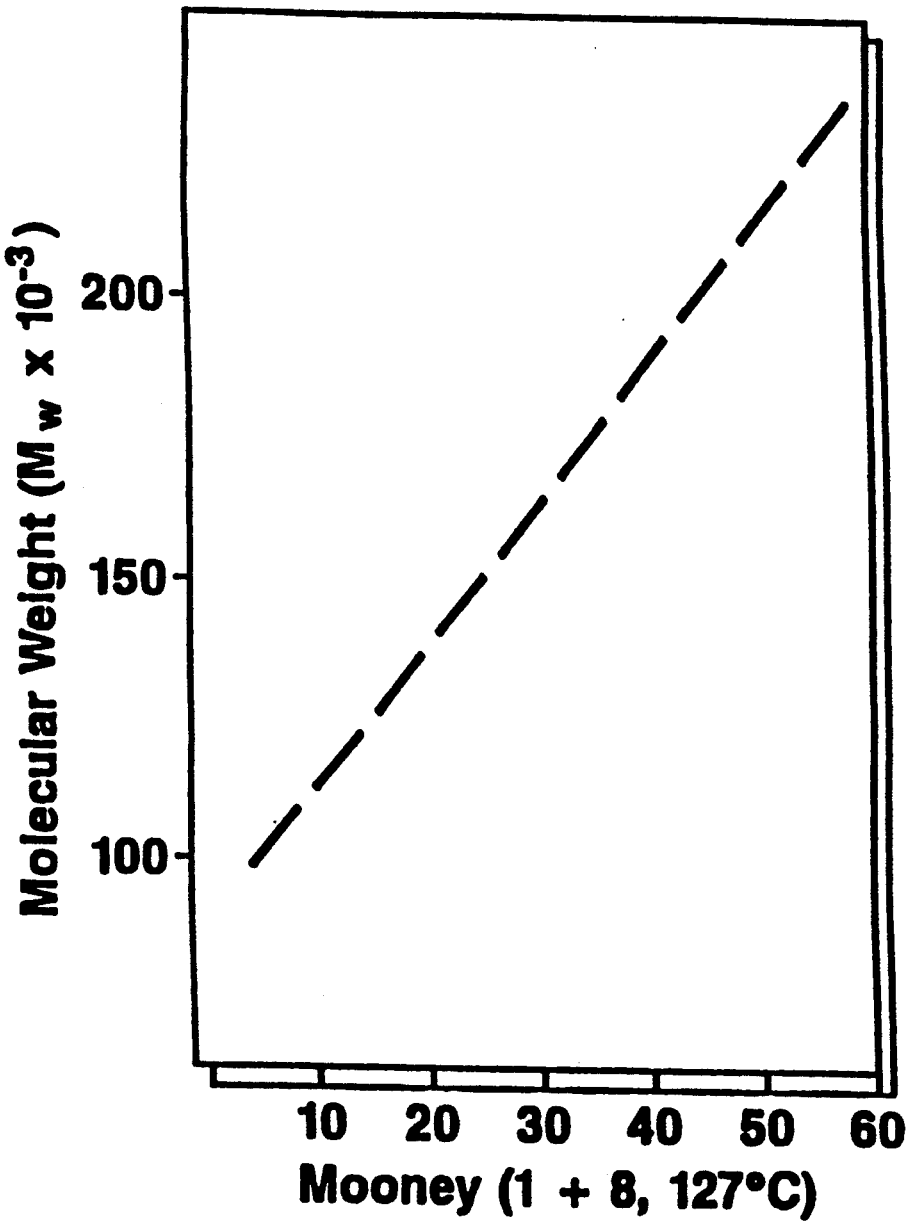
FIG. 1 is a graph correlating $M_w$ with Mooney viscosity.

In accordance with the present invention a polyethylene/polypropylene blend is provided especially useful for the production of fibers and nonwovens. By using a low molecular weight plastomer as a compatibilizer, it has been discovered that linear low density polyethylene (LLDPE) can be dispersed in a generally continuous matrix of polypropylene. The dispersion results in relatively small particles of the LLDPE dispersed through the polypropylene matrix phase which facilitate processability of the blend into melt spun or melt blown biconstituent fibers having a good balance of strength and hand.

Broadly, in accordance with the present invention the present invention polyethylene/polypropylene blend of crystalline polypropylene, LLDPE and a plastomer is provided. The polypropylene preferably comprises more than about 50 percent by weight of the blend. The LLDPE preferably comprises at least about 10 but less than about 50 percent by weight of the blend. The LLDPE is dispersed in a matrix of the polypropylene. The plastomer acts as a compatibilizer, thus a compatibilizing amount of the plastomer is present. The plastomer is an ethylene/alpha-olefin copolymer having a weight average molecular weight between about 5000 and about 50,000, a density between about 0.865 g/cm$^3$ and about 0.90 g/cm$^3$, and a melt index of at generally above 50 dg/min.

In another aspect, the present invention provides fibers made from the plastomer-compatibilized polyethylene/polypropylene blend. Melt spun fibers are preferably prepared from the blend wherein the polypropylene has a melt flow rate from about 20 to about 50 dg/min, preferably at least about 35 dg/min. Melt blown fibers are preferably prepared from the blend wherein the polypropylene has a melt flow rate of from about 400 to about 1000 dg/min. In either case, the polypropylene is preferably of controlled rheology having $M_w/M_n$ less than about 4, especially from about 1.5 to about 2.5. The LLDPE preferably comprises a copolymer of ethylene and at least one $C_4$–$C_{12}$ alpha-olefin, has a density from about 0.915 to about 0.94 g/cm$^3$, and a melt index from about 10 to about 100 dg/min.

In a further aspect of the invention, there is provided a nonwoven fabric made from a melt spun or melt blown blend of the compatibilized polyethylene/polypropylene.

DETAILED DESCRIPTION OF THE INVENTION

The blend of the present invention includes crystalline polypropylene, linear low density polyethylene (LLDPE), and a plastomer as the essential constituents. The primary constituent is polypropylene, preferably in an amount at least about 50 weight percent by weight of the blend, more preferably from about 50 to about 85 weight percent, more preferably about 55 to about 80 weight percent, even more preferably about 60 to about 75 weight percent. If insufficient polypropylene is employed, the strength characteristics of the blend are adversely affected. If too much polypropylene is employed, the blend properties imparted by the presence of the compatibilized polyethylene, i.e. improved hand, are not achieved.

The polypropylene is generally crystalline, for example, isotactic. The polypropylene is generally prepared by conventional controlled rheological treatment of a high molecular weight polypropylene (which is made by polymerizing propylene in the presence of a Ziegler Natta catalyst under temperatures/conditions well known in the art) with peroxide or another free-radical initiator to provide a polypropylene having a lower molecular weight and a narrow molecular weight distribution. The polypropylene preferably has $M_w/M_n$ less than about 4, and especially from about 1.5 to about 2.5. The MFR of the polypropylene depends on the intended application of the blend. For example, where the blend is to be melt spun into fiber, the MFR of the polypropylene should be at least 20 dg/min, preferably at least about 35 dg/min. For melt blown fiber which generally requires a lower melt viscosity, the polypropylene should have an MFR in the range from about 400 to about 1000 dg/min. As used herein, polypropylene MFR is determined in accordance with ASTM D-1238, condition L. Such polypropylene is well known in the art and is commercially available.

The LLDPE which is used in the blend and fiber of the present invention is a copolymer of ethylene and at least one alpha-olefin having from 3 to about 12 carbon atoms, preferably 4 to 8 carbon atoms. The alpha-olefin comonomer(s) generally comprises from about 1 to about 15 weight percent of the LLDPE. The LLDPE generally has a density in the range from about 0.915 to about 0.94 g/cm$^3$, and a melt index from about 10 to about 100 dg/min. As used herein, the MI of LLDPE is determined in accordance with ASTM D-1238, condition E.

The LLDPE constituent should be present in the blend in an amount sufficient to obtain the desired properties, for example, improved hand, without seriously detracting from the desirable properties of the polypropylene, for example, strength and processability. The LLDPE preferably comprises from about 10 to about 50 percent by weight of the blend, more preferably from about 15 to about 40 percent by weight, even more preferably about 20 to about 30 weight percent.

The plastomer is a low molecular weight ethylene/alpha-olefin copolymer which has properties generally intermediate to those of thermoplastic materials and elastomeric materials, hence the term "plastomer." The plastomers used in the blend and fiber of this invention comprise ethylene and at least one $C_3$–$C_{20}$ alpha-olefin, preferably a $C_4$–$C_8$ alpha-olefin, polymerized in a linear fashion using a single site metallocene catalyst such as the catalysts disclosed in European Patent to Welborn EP 29,368, U.S. Pat. No. 4,752,597to Turner, U.S. Pat. Nos. 4,808,561 and 4,897,455to Welborn, which are herein incorporated by reference. The alpha-olefin comonomer may be present at about 5 to 25 mole percent, preferably about 7 to about 22 mole percent, more preferably between about 9 to 18 mole percent. In general the plastomer has a density in the range of about 0.865 g/cm$^3$ to about 0.90 g/cm$^3$. The plastomer generally has $M_w$ in the range of from about 5000 to about 50,000, preferably from about 20,000 to about 30,000. The melt index of the plastomer is generally above about 50 dg/min, preferably from about 50 to about 200 dg/min, as determined in accordance with ASTM D-1238, condition E. The plastomer is used in an amount sufficient to compatibilize the LLDPE/polypropylene blend, i.e. to facilitate dispersion of the LLDPE in the polypropylene. An excessive amount of the plastomer is preferably avoided so that the desirable strength properties of the polymer are not adversely affected thereby. Preferably, the plastomer is used in an amount of from about 2 to about 15 weight percent, more preferably about 5 to about 12 weight percent. The plastomer is also characterized by an X-ray crystallinity of at least 10%, preferably at least 15 to about 25%.

Plastomers differ from elastomers in some significant ways. An elastomer typically has a density from 0.86 to 0.875, a high molecular weight (100,000+Mw) and is typically used to make molded articles such as tires, car bumpers, etc. the instant plastomer has a density of 0.88 to 0.90 and a Mw of 5,000 to 50,000.

In addition, plastomers and elastomers differ in specific properties. Plastomers have higher crystallinity than elastomers, which contributes to increased tensile strength and greater abrasion resistance. Less crystalline elastomers typically do not have nearly the same abrasion resistance and tensile strength. As a consequence, plastomers unlike elastomers, can be utilized "neat," without the need for filling and/or crosslinking. Data that evidence the property differences between plastomers and elastomers are shown in Table I.

TABLE I

ANALYTICAL AND PROPERTY/PERFORMANCE DIFFERENCES BETWEEN ETHYLENE/ALPHA-OLEFIN ELASTOMERS AND PLASTOMERS

| | PLASTOMER EXXON EXACT 3017C | ELASTOMER DUPONT NORDEL 2722 | ELASTOMER MITSUI TAFMER P-0480 |
|---|---|---|---|
| Mw (wt. avg.) | 42,000 | 97,000 | 100,000 |
| COMPOSITION (MOLE % COMONOMER) | $C_2$=/BUTENE-1 7.7 MOLE % $C_4$= | EPDM 19 MOLE % $C_3$= | EP 24 MOLE % $C_3$= |
| DENSITY (g/cm$^3$) | 0.901 | 0.872 | 0.8666 |
| X-RAY CRYSTALLINITY (%) | >20 | 7 | <5 |
| TENSILE STRENGTH AT BREAK (psi) (ASTM D-638) | 1250 | 730 | 300 |
| TENSILE IMPACT STRENGTH (ft lb/in$^2$) (ASTM D-1822) | 105 | 210 | 90 |
| SHORE "A" HARDNESS (ASTM D-2240) | >80 | 71 | 66 |

1. Physical properties measured on compression molded pads of neat base polymer.
2. X-ray crystallinity determined by X-ray diffraction techniques (see L. E. Alexander X-ray Diffraction Methods in Polymer Science, Wiley (Interscience), New York, 1969).

The data in Table 1 show that even though the molecular weight of applicants' claimed plastomer is less than half that for the elastomer products, the "neat" plastomer offers a better balance of physical properties, i.e. tensile strength at break>1000 psi; tensile impact strength>100 ft.lb/in$^2$; shore "A" hardness>80, as opposed to teh elastomer products.

Table I shows the plastomers to have better tensile strength, good impact strength and better abrasion resistance (through the higher hardness value) than the elastomer products. Further is achieved with a lower molecular weight product, in direct contradiction to the expected norm, i.e. that as Mw falls, the strength properties fall.

In more technical parlance, key analytical differentiating features of a plastomer vis-a-vis an ethylene/alpha-olefin elastomer are its lower molecular weight and its higher crystallinity (or density). The majority of ethylene/alpha-olefin elastomers are >20 Mooney viscosity (at 125° C.), a typically used unit to characterize molecular weight. A Mooney viscosity >20 (at 125° C.) translates to a molecular weight ($M_w$, the weight average)>100,000 (see FIG. 2 for a correlation of Mooney viscosity with $M_w$). By contrast, our defined plastomers box comprises polymers<100,000 $M_w$. On crystallinity, ethylene/alpha-olefin elastomers are generally substantially amorphous, having x-ray crystallinity levels generally <7% (densities >0.875 g/cm$^3$). By contrast, our plastomers comprises polymers for the most part >0.875 g/cm$^3$. Specifically, the plastomers with 0.89 g/cm$^3$, or about 20% crystallinity and 20,000 to 30,000 $M_w$ are clearly outside the generally accepted definition of ethylene/alpha-olefin elastomers and could not be made by standard manufacturing units/procedures used generally to produce ethylene/alpha-olefin elastomers. The analytical differences highlighted above translate to property and performance differences. For example, because ethylene/alpha-olefin elastomers are substantially amorphous, they have poor intrinsic tensile properties, low abrasion resistance (e.g. low hardness) and low modulus. As a consequence they are seldom, if ever, used without being filled and/or cross linked. Alternately, they are blended with other polymers to derive useful strength properties. By contrast, plastomers offer adequate inherent tensile and impact properties etc., such that they can be utilized "neat", without the need for filling and/or cross linking. Examples showing this practical differentiation are provided in Table 1.

Yet another means of differentiating plastomers from elastomers is in their application in blends. An important commercial application for ethylene/alpha-olefin elastomers is in blends with other polymers (e.g. blends with polypropylene for impact strength enhancement). It is well known in the art that the closer the viscosity match of the blend partners, the better the dispersion and the smaller the size of the dispersed particles, for imisicible systems. It is also well known that smaller particle sizes (generally 1-2 microns or smaller) provide good mechanical properties (e.g. impact strength). Plastomers offer a different response, versus ethylene/alpha-olefin elastomers, in this area. Their lower molecular weights allow easy blending utilizing standard mixing techniques, yielding well dispersed blends of favorably small particle size. In contrast, the blend viscosity match-up with ethylene/alpha-olefin elastomers (higher molecular weight) is poorer. To achieve good dispersions and favorably small particle sizes, special mixing equipment/mixing procedures are generally required. The lower molecular weight of the plastomers means that there is a better dispersion. This contributes to faster and easier processing. Thus, these blends can be processed on standard machinery without having to make expensive adjustments, unlike the high Mw elastomers of the references.

The blend of the present invention may also contain relatively minor amounts of conventional polyolefin additives such as colorants, pigments, UV stabilizers, antioxidants, heat stabilizers and the like which do not significantly impair the desirable features of the blend. However, the blend should be essentially free of additives which adversely affect the compatibility of the blend components, and particularly such components which adversely affect the ability to form the blend into fiber.

The blend constituents may be blended together in any order using conventional blending equipment, such as, for example, roll mills, Banbury mixer, Brabender, extruder and the like. A mixing extruder is preferably used in order to achieve good dispersion of the compatibilized LLDPE particles in a continuous polypropylene matrix. In an unoriented state, i.e. before fiber formation or other mechanical drawing, the blend is characterized by a dispersion of relatively fine particles of LLDPE suspended in the polypropylene. Of course, when the blend is oriented as in fiber formation, or other mechanical drawing techniques, the particles become more ellipsoid and/or fibrile than spherical. The spherical LLDPE particles generally have a particle size less than about 30 microns, preferably from about 1 to about 5 microns. This is in sharp contrast to the prior art blends prepared without the plastomer compatibilizer which result in relatively large particles of the dispersed phase, and in extreme cases, even cocontinuous phases, which adversely affect fiber formation.

The blend of the present invention may be formed into fiber using conventional fiber formation equipment, such as, for example, equipment commonly employed for melt spinning or to form melt blown fiber, or the like. In melt spinning, either monofilaments or fine denier fibers, a higher melt strength is generally required, and the polypropylene preferably has an MFR of from about 20 to about 50 dg/min. A target MFR for the polypropylene of about 35 dg/min is usually suitable. Typical melt spinning equipment includes a mixing extruder which feeds a spinning pump which supplies polymer to mechanical filters and a spinnerette with a plurality of extrusion holes therein. The filament or filaments formed from the spinnerette are taken up on a take up roll after the polyolefin has solidified to form fibers. If desired, the fiber may be subjected to further drawing or stretching, either heated or cold, and also to texturizing, such as, for example, air jet texturing, steam jet texturing, stuffing box treatment, cutting or crimping into staples, and the like.

In the case of melt blown fiber, the blend is generally fed to an extrusion die along with a high pressure source of air or other inert gas in such a fashion as to cause the melt to fragment at the die orifice and to be drawn by the passage of the air into short fiber which solidifies before it is deposited and taken up as a mat or web on a screen or roll which may be optionally heated. Melt blown fiber formation generally requires low melt viscosity material, and for this reason, it is desirable to use a polypropylene in melt blown fiber formation which has an MFR in the range from about 400 to about 1000 dg/min.

In a preferred embodiment, the blend of the present invention may be used to form nonwoven fabric. The fiber can be bonded using conventional techniques, such as, for example, needle punch, adhesive binder, binder fibers, hot embossed roll calendaring and the like. In a particularly preferred embodiment, the fiber of the present invention can be used to form a fabric having opposite outer layers of melt spun fiber bonded to an inner layer of melt blown fiber disposed between the outer melt spun layers. Typically, each outer layer is from about 5 to about 10 times thicker than the inner layer. The melt spun fiber prepared from the present invention is preferably used as one or both outer layers, and the melt blown fiber of the present invention for the inner melt blown fiber layer, although it is possible, if desired, to use a different material for one or both of the spun bonded layers or a different melt blown fiber for the inner melt blown fiber layer. Conventional heated calendaring equipment can be used, for example, to bond the outer melt spun fiber layers to the intermediate melt blown fiber layer by heating the composite layered structure sufficiently to at least partially melt the inner layer which melts more easily than the outer layers. As is known, insufficient heating may not adequately bond the fibers, whereas excessive heating may result in complete melting of the inner and/or outer layers and void formation. Upon cooling, the inner melt blown layer fuses to the fiber in the adjacent outer layers and bonds the outer layers together.

It is also contemplated that the blend of the present invention can be used as one component of a bicomponent fiber wherein the fiber includes a second component in a side-by-side or sheath-core configuration. For example, the polypropylene/LLDPE blend and polyethylene terephthalate (PET) can be formed into a side-by-side or sheath-core bicomponent fiber by using equipment and techniques known for formation of polypropylene/PET bicomponent.

The present invention is illustrated by the examples which follow.

EXAMPLE 1

Polypropylene, LLDPE and plastomer in a weight ratio of 70/20/10 were blended together and formed into pressed film and monofilament for evaluation. The polypropylene was prepared from a 1.0 MFR polypropylene by peroxide treatment to obtain a controlled rheology polypropylene of 35 MFR. The LLDPE was a copolymer of ethylene and 4 weight percent 1-butene, having a density of 0.924 g/cm$^3$ and a 22 MI. The plastomer was an ethylene-butene copolymer with a 120 MI and a 0.89 g/cm$^3$ density. The blend was mixed in a Brabender mixer at 170°-200° C. for 5-10 minutes with a mixing head speed of about 60-80 rpm. The blend was pressed into films using a Carver press at about 100 psi at 170°-200° C. for about 1-4 minutes. The composition of Example 1 is summarized in Table 2 below. Low voltage scanning electron micrographs of the pressed film revealed a dispersed morphology wherein the LLDPE was dispersed in a continuous phase of the polypropylene. The LLDPE particles were in the 1-2 micron size range. The film had a stress at break of 4110 psi, a strain at break of 10 percent, a modulus of 104,000 psi and impact strength of 5 lbs/in. The physical properties are summarized in Table 3 below. The blend was also formed into a fiber using a special one-hole die apparatus in which the polymer blend was melted at 180°-250° C. in a device similar to a melt indexer and drawn from the die hole by a take up spool at faster and faster speeds until the fiber breaks away from the die.

The fiber exhibited a compliance of 2.4, could be spun at a rate of 440 feet/min, and had a melt strength of 3.2 g. The fiber formation and morphology are summarized in Table 4 below.

EXAMPLE 2

The equipment and procedures of Example 1 were used to prepare a similar blend of 60 weight percent polypropylene, 30 weight percent LLDPE and 10 weight percent plastomer. The polypropylene was a controlled rheology polypropylene of 400 MFR prepared from a 1.0 MFR polypropylene by peroxide treatment. The LLDPE was a copolymer of ethylene and 2.8 mole percent 1-octene having a density of about 0.92 g/cm$^3$ and 117 MI. The same plastomer as in Example 1 was used. The composition of Example 2 is summarized in Table 2 below. A low voltage scanning electron micrograph of the blend revealed a dispersed morphology wherein the LLDPE was dispersed in a continuous phase of the polypropylene. The LLDPE particles where in the 1-30 micron size range. The MFR of the polypropylene was too high to make a film for mechanical testing or fiber from the one-hole die apparatus. The blend is made into melt blown fiber with acceptable properties.

COMPARATIVE EXAMPLE A

The procedures and techniques of Example 1 were used to prepare a blend of 60 weight percent polypropylene, 40 weight percent LLDPE and no plastomer. In contrast to the compatibilized polypropylene/LLDPE blends of Example 1, Comparative Example A had a high compliance (5.1), could only be spun at low speeds (240 feet/min) and exhibited a low melt strength and a cocontinuous morphology with some dispersed LLDPE particles in the polypropylene cocontinuous phase. The composition, physical properties and spinning and morphological characteristics are summarized in Tables 2, 3 and 4 below.

COMPARATIVE EXAMPLE B

The procedures and techniques of Example 1 were used to prepare a blend of 47.5 weight percent polypropylene, 47.5 weight percent LLDPE and 5 weight percent plastomer. In contrast to the compatibilized polypropylene/LLDPE blends of Example 1, Comparative Example B could not be spun even at low speeds (below 25 feet/min) and exhibited a cocontinuous morphology. The composition, physical properties and spinning and morphological characteristics are summarized in Tables 2, 3 and 4 below.

TABLE 2

| | COMPOSITION (WT %) | | |
|---|---|---|---|
| EXAMPLE | POLYPROPYLENE[1] | LLDPE[2] | PLASTOMER[3] |
| 1 | 70 | 20 | 10 |

TABLE 2-continued

| | COMPOSITION (WT %) | | |
|---|---|---|---|
| EXAMPLE | POLYPROPYLENE[1] | LLDPE[2] | PLASTOMER[3] |
| COMP. A | 60 | 40 | 0 |
| COMP. B | 47.5 | 47.5 | 5 |
| 2 | 60[4] | 30[5] | 10 |

1. 35 MFR; 2.5 $M_w/M_n$.
2. 22 MI; 0.924 g/cm$^3$; 4 wt % butene
3. 120 MI; 0.89 g/cm$^3$; butene-1 copolymer.
4. 400 MFR; 3.7 $M_w/M_n$.
5. 117 MI; 0.92 g/cm$^3$; 2.8 mole % 1-octene.

TABLE 3

| EXAMPLE | STRESS (psi) | STRAIN (%) | MODULUS (kpsi) | IMPACT STRENGTH (lb/in.) |
|---|---|---|---|---|
| 1 | 4110 | 10 | 104 | 5 |
| COMP. A | 2430 | 5 | 85 | <1 |
| COMP. B | 2520 | 10 | 67 | <1 |

TABLE 4

| EXAMPLE | COMPLIANCE (%) | SPEED TO BREAK (ft/min) | MELT STRENGTH (g) | MORPHOLOGY (particle size, mm) |
|---|---|---|---|---|
| 1 | 2.4 | 440 | 3.2 | Dispersed (1-2) |
| COMP. A | 5.1 | 240 | 1.4 | Cocontinuous/ Dispersed (>>10) |
| COMP. B | 2.9 | Could Not Spin | N/A | Cocontinuous (>>20) |
| 2 | N/A | N/A | N/A | Dispersed (1-30) |

N/A = Data not available.

From the foregoing, it is seen that compatibilized blends of polypropylene and LLDPE wherein polypropylene is the primary constituent can be prepared by employing a plastomer compatibilizer. In contrast, blends prepared without the compatibilizer do not have the necessary properties for easy fiber formation, and have inferior mechanical properties. However, the foregoing teachings are intended only to illustrate and explain the invention and the best mode contemplated, and are not intended to limit the invention. Variations and modifications will occur to those skilled in the art in view of the foregoing. It is intended that all such variations and modifications which fall within the scope or spirit of appended claims be embraced thereby.

What is claimed is:

1. A polyethylene/polypropylene blend, comprising:
at least 50 percent by weight of crystalline polypropylene;
at least about 10 percent by weight of linear low density polyethylene having a density of about 0.915 to about 0.94
dispersed in a matrix of said polypropylene; and
a compatibilizing amount of an ethylene/alpha-olefin plastomer having an alpha-olefin content of from about 5 to about 25 mole percent, a melt index of above about 50 dg/min, a weight average molecular weight between about 5000 and about 50,000, a density of from about 0.88 about 0.90 g/cm$^3$ and an X-ray crystallinity of at least 10%.

2. The blend of claim 1, wherein said polypropylene is isotactic.

3. The blend of claim 1, wherein said polypropylene has a melt flow rate greater than 20 dg/min.

4. The blend of claim 1, wherein said polypropylene has a melt flow rate of from about 400 to about 1000 dg/min.

5. The blend of claim 1, wherein said polypropylene has $M_w/M_n$ less than about 4.

6. The blend of claim 1, wherein said linear low density polyethylene comprises a copolymer of ethylene and at least one $C_4$–$C_{12}$ alpha-olefin and has a density from about 0.915 to about 0.94 g/cm$^3$.

7. The blend of claim 1, wherein said plastomer comprises from about 2 to about 15 percent by weight of said blend.

8. A fiber melt spun from the blend of claim 1.

9. The fiber of claim 8, wherein said polypropylene has a melt flow rate from about 20 to about 50 dg/min.

10. A fiber melt blown from the blend of claim 1.

11. The fiber of claim 10, wherein said polypropylene has a melt flow rate from about 400 to about 1000 dg/min.

12. A nonwoven fabric, comprising fiber melt spun from the polyethylene/polypropylene blend of claim 1.

13. The nonwoven fabric of claim 12, wherein said polypropylene has a melt flow rate greater than 20 dg/min.

14. A nonwoven fabric comprising fiber melt blown from the polyethylene/polypropylene blend of claim 1.

15. The nonwoven fabric of claim 14, wherein said polypropylene has a melt flow rate from about 400 to about 1000 dg/min.

16. The blend of claim 1, wherein the plastomer is an ethylene/$C_3$–$C_{20}$ alpha olefin copolymer.

17. The copolymer of claim 1, wherein the alpha-olefin is present from about 7 to about 22 mole percent.

18. The of claim 1, wherein the alpha-olefin is present from about 9 to about 18 mole percent.

19. The blend of claim 1, wherein the plastomer is present from about 5 to about 12 weight percent.

20. The blend of claim 1, wherein the polypropylene is present from about 50 to about 85 weight percent.

21. The blend of claim 1, wherein the polypropylene is present from about 55 to about 80 weight percent.

22. The blend of claim 1, wherein the polypropylene is present from about 60 to about 75 weight percent.

23. The blend of claim 1, wherein the LLDPE is present from about 10 to about 50 weight percent.

24. The blend of claim 1, wherein the LLDPE is present from about 15 to about 40 weight percent.

25. The blend of claim 1, wherein the LLDPE is present from about 20 to about 30 weight percent.

26. The blend of claim 1, wherein the plastomer has a weight average molecular weight of 20,000 to 30,000.

27. The blend of claim 1, wherein the plastomer has an X-ray crystallinity of 15 to 25%.

28. The blend of claim 1, wherein the plastomer has an X-ray crystallinity of 10 to 25%.

29. The blend of claim 1, wherein the plastomer has an X-ray crystallinity of 20 to 25%.

30. The blend of claim 1, wherein the plastomer has a density of 0.89 dg/min or greater.

31. An article made from the blend of claim 1.

32. The blend of claim 1, wherein the polypropylene is present from about 60 to about 75 weight percent, the linear low density polyethylene is present at from about 20 to about 30 weight percent, the plastomer is present at about 5 to 12 weight percent and is a copolmer of ethylene and about 5 to about 25 mole % of a $C_3$ to $C_6$ alpha olefin, having a weight average molecular weight of 20,000 to about 50,000, a density of 0.89 to 0.90, an MI of 50 to about 200 dg/min and an X-ray crystallinity of at least 10%.

* * * * *